US009079693B2

(12) United States Patent
Kidd et al.

(10) Patent No.: US 9,079,693 B2
(45) Date of Patent: Jul. 14, 2015

(54) BOTTLE CLOSURE AND METHOD OF USING THE SAME

(71) Applicant: Berlin Packaging, LLC, Chicago, IL (US)

(72) Inventors: Patrick Kidd, Bondi Junction (AU); Aimee Reynolds, Bondi Junction (AU); Brett R. Niggel, Chicago, IL (US); Liam Hawry, Chicago, IL (US)

(73) Assignee: Berlin Packaging, Chicago, IL (US)

( * ) Notice: Subject to any disclaimer, the term of this patent is extended or adjusted under 35 U.S.C. 154(b) by 157 days.

(21) Appl. No.: 13/961,863

(22) Filed: Aug. 7, 2013

(65) Prior Publication Data

US 2014/0305899 A1 Oct. 16, 2014

(51) Int. Cl.
*B65D 41/00* (2006.01)
*B65D 41/18* (2006.01)

(52) U.S. Cl.
CPC ..... *B65D 41/18* (2013.01)

(58) Field of Classification Search
CPC ..... B65D 41/18
USPC ..... 215/235, 237, 244, 275, 276
See application file for complete search history.

(56) References Cited

U.S. PATENT DOCUMENTS 5,314,093 A * 5/1994 Gross et al. ..... 222/153.14
6,997,104 B1 * 2/2006 Lin ..... 99/323.3
2010/0308125 A1 * 12/2010 Depiano et al. ..... 239/4
2012/0046582 A1 * 2/2012 Hopman et al. ..... 602/4
2012/0111821 A1 * 5/2012 Starr et al. ..... 215/235

* cited by examiner

*Primary Examiner* — Anthony Stashick
*Assistant Examiner* — Raven Collins
(74) *Attorney, Agent, or Firm* — Adam K. Sacharoff; Much Shelist

(57) ABSTRACT

A bottle closure (100) for a bottle (200) comprises a first closure (500) securable over an opening of the bottle (200). The first closure (500) having a central generally circular projection (540), and a liquid flow aperture (512) located adjacent to the projection. A second closure (600) is located over the first closure (500), the second closure (600) having a generally circular aperture (632) adapted to receive the circular projection (540), the second closure (600) being movable between a first position and a second position. In the first position the circular projection (540) generally occludes flow through the circular aperture (632), and in the second position the circular projection (540) is adjacent to the circular aperture (632), providing a fluid flow path from the bottle, through the liquid flow aperture (512) and the circular aperture (632). The first closure (500) includes a first engagement formation (504) and the second closure (600) includes a corresponding second engagement formation (602). The first and second engagement formations (504, 602) being adapted to move the second closure (600) both longitudinally and pivotally about a longitudinal axis (XX) as the second closure (600) moves between the first position and the second position.

10 Claims, 13 Drawing Sheets

BOTTLE CLOSURE AND METHOD OF USING THE SAME

RELATED APPLICATION

This Application claims priority to Australian Provisional Application No. 2013901258, filed Apr. 12, 2013, hereby incorporated by reference.

FIELD OF THE INVENTION

The present invention relates to a bottle closure. In particular, the present invention relates to a bottle closure for use with cosmetic products, such as shampoo and conditioner. However, it will be appreciated that the bottle closure can be applied to numerous other applications.

BACKGROUND OF THE INVENTION

Shampoo and conditioner bottles typically incorporate a snap type lid. Snap type lids generally include a body portion that covers the opening of the bottle, and a cap. The body portion of the lid typically screws onto an externally threaded boss extending away from the bottle. Alternatively, the body portion of the snap type lid may be semi-permanently engaged with the bottle by interference.

In operation this means that the bottle is initially sealed, and in order to extract some of the shampoo or conditioner, the user must undo the cap. This generally necessitates the use of two hands during opening and closing. That is, one hand is required to hold the bottle and another hand to open and/or close the cap. This procedure can be difficult for persons with disabilities, and this problem is compounded by the size of the cap, which is typically quite small.

A further disadvantage with snap type lids is that the connection between the cap and the body is generally provided by a small web of plastic. This web is known to sometimes break or otherwise fail after prolonged periods of use or impact, for example by dropping. The breakage of the web may render the shampoo or conditioner bottle useless if the cap is subsequently lost, as the bottle can no longer be safely transported without risk of spillage of the contents.

In addition, when the web becomes broken, it can become difficult to re-seal the bottle, as the cap and body often only mate correctly at a particular angular orientation. In the event that the web is broken, the correct closing angular position can be difficult to identify. This can result in the user thinking the bottle is closed, when in reality the cap does not correctly seal the bottle.

Another type of shampoo or conditioner bottle uses a pump action type of nozzle to dispense the contents. Whilst such dispensers are adapted to dispense a measured volume of the contents during each press of the nozzle, they suffer from several drawbacks. One such drawback is that it can be difficult to extract the final portion of the contents of the bottle, as the stem of the pump action unit does not generally extend all the way to the bottom of the bottle. In addition, the pump action unit can become blocked or clogged, especially given that the liquid contents are typically quite viscous.

Another common lid type utilised with shampoo and conditioner bottles is a separate screw top lid. This requires screwing the lid on and off for each use. The use of a screw top lid for such shampoo and conditioner bottles is inefficient and impractical. Two hands are required to navigate the dispensing of liquid, one to hold the lid and one to dispense shampoo whilst at the same time pouring shampoo into one of the hands.

A further disadvantage with some known shampoo or conditioner bottles, is that they are often visually unsightly, on account of their utilitarian nature. They often resemble similar disposable bottles which are used for example for household cleaning products, and as such can be visually unappealing. This is especially relevant considering that shampoo and conditioner bottles are often left in a shower or bath recess, where they are continuously visible, and can have an impact on the overall appearance of the room.

OBJECT OF THE INVENTION

It is an object of the present invention to substantially overcome or at least ameliorate one or more of the above disadvantages, or to provide a useful alternative.

SUMMARY OF THE INVENTION

In a first aspect, the present invention provides a bottle closure for a bottle, the bottle closure comprising:

- a first closure securable over an opening of the bottle, the first closure having a central generally circular projection, and a liquid flow aperture located adjacent to the projection;
- a second closure located over the first closure, the second closure having a generally circular aperture adapted to receive the circular projection, the second closure being movable between a first position and a second position,
- wherein in the first position the circular projection generally occludes flow through the circular aperture, and in the second position the circular projection is adjacent to the circular aperture, providing a fluid flow path from the bottle, through the liquid flow aperture and the circular aperture;
- further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position.

The first engagement formation preferably includes at least one helical groove, and the second engagement formation includes a corresponding projection.

The first engagement formation preferably includes two diametrically opposing helical grooves.

The first closure preferably includes an annular ring adapted to engage with a barb formed on the bottle to secure the first closure to the bottle.

The bottle closure preferably further comprises a flexible valve, the flexible valve being located adjacent to the circular aperture.

The flexible valve is preferably manufactured from an elastically deformable polymer.

The flexible valve preferably includes two generally perpendicular slits defining a cross shaped aperture.

The second closure preferably includes two diametrically opposing lugs.

The bottle closure further preferably comprises a base plate, the base plate being securable to the bottle by a rim of the first closure, the base plate having two channels adapted to receive the two diametrically opposing lugs.

The base plate is preferably pivotable about the longitudinal axis relative to the bottle, further wherein pivoting the base plate through about 180° results in the second closure moving between the first position and the second position.

The bottle closure further preferably comprises a sleeve located around the base plate, the sleeve having an external cross-section when viewed in a plane extending perpendicular to the longitudinal axis which generally corresponds with an external cross-section of the bottle.

The flexible valve is preferably secured to and adapted to rotate with the base plate.

An annular shoulder of the flexible valve is preferably clamped to a top plate with a retainer ring, the top plate being secured to the base plate.

The flexible valve and the second closure are preferably rotationally coupled to pivot the same degree around the longitudinal axis between the first position and the second position.

The flexible valve preferably has a generally cup-shaped body, and the perpendicular slits are located at a low point of the cup-shaped body.

BRIEF DESCRIPTION OF THE DRAWINGS

A preferred embodiment of the invention will now be described by way of specific example with reference to the accompanying drawings, in which.

DETAILED DESCRIPTION OF THE PREFERRED EMBODIMENTS

Figure 1:
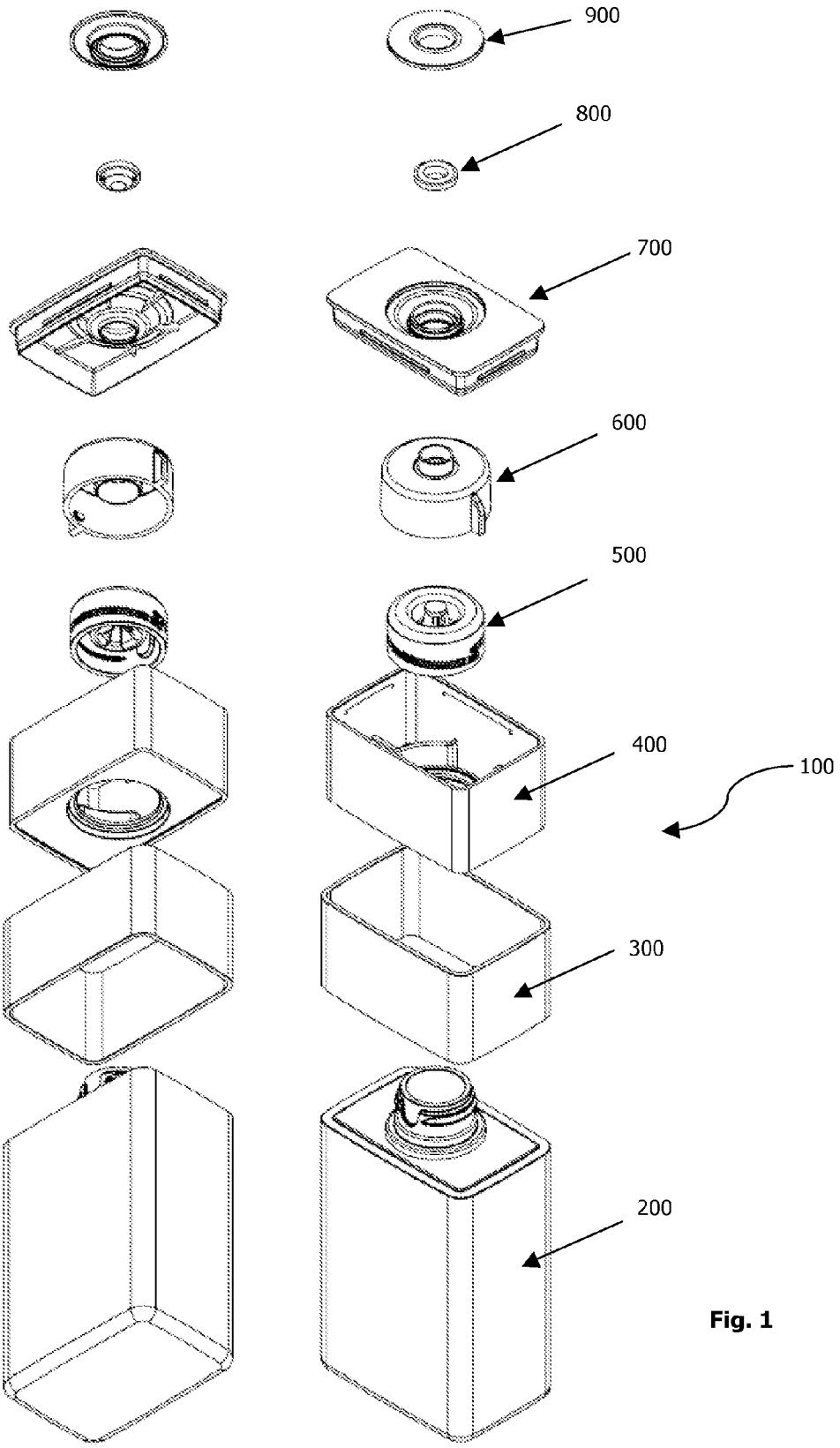
FIG. 1 is an exploded perspective view of a bottle closure and bottle.

The individual components of a bottle closure 100 are depicted in FIG. 1. In that figure, the left side of the figure is a perspective exploded view, partially depicting the bottle components from below. In contrast, the right side of the figure is a perspective exploded view, partially depicting the components from above.

Figure 4:
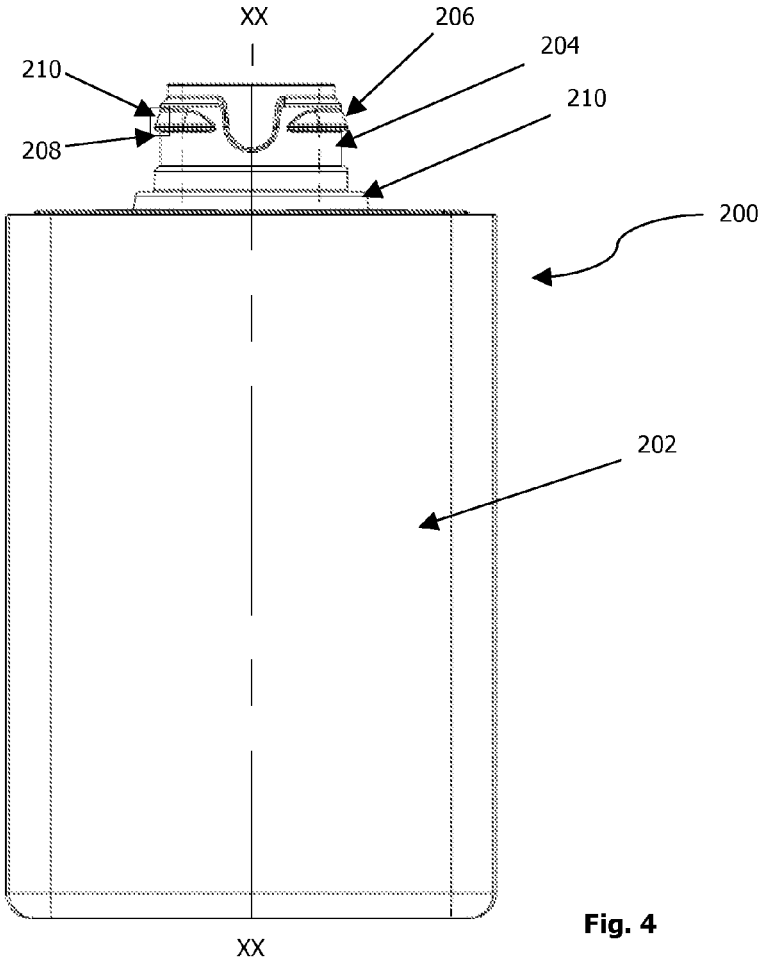
FIG. 4 is a side view of the bottle of FIG. 3.

The bottle closure 100 is adapted to seal a bottle 200, such as a shampoo, conditioner or other such bottle 200. As best seen in FIG. 4, the bottle 200 is formed with a body 202 and a mouth or opening 204. In the embodiment depicted in the drawings, the body 202 has a generally rectangular cross-section, when viewed through a plane extending perpendicular to the longitudinal axis XX. However, it will be appreciated that the body 202 may be formed with a circular, elliptical, triangular, polygonal or other such cross-sectional shape.

Adjacent to the mouth 204, the bottle 200 includes a radially extending engagement formation in the form of a barb 206. The barb 206 has a step 208 located on one side, and a tapering surface 210 located on the opposing side, which is closer to the mouth 204 of the bottle 200. At the junction region which is located between the body 202 of the bottle 200 and the mouth 204, a radial step 210 is defined.

Figure 5:
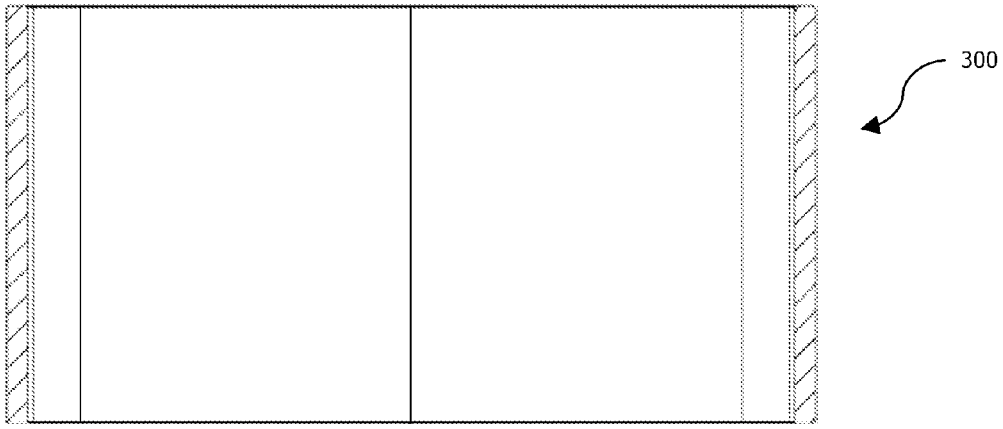
FIG. 5 is a side view of a sleeve of the bottle closure of FIG. 1.
Figure 6:
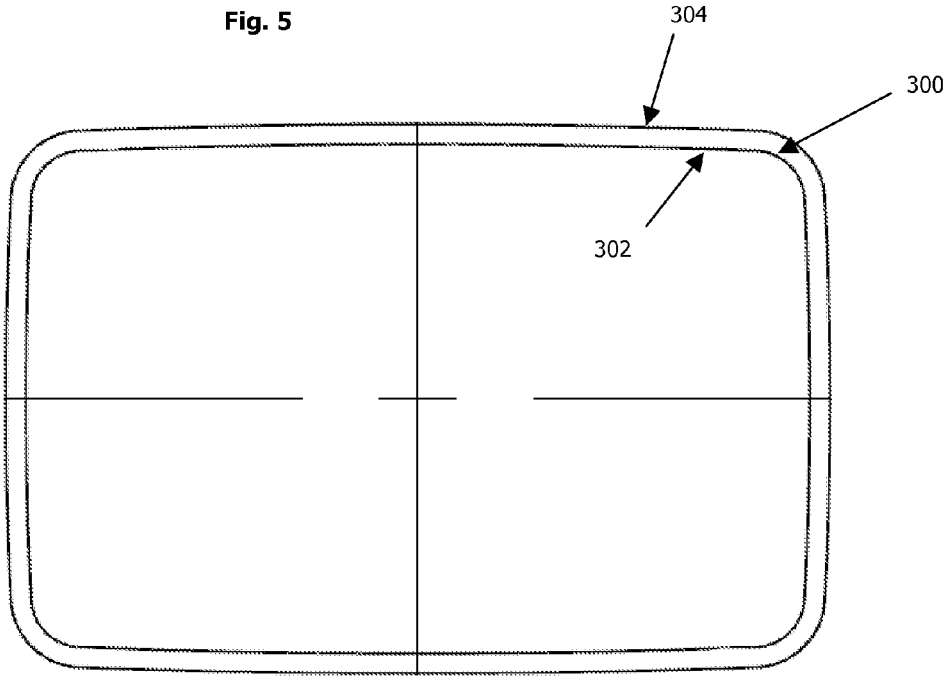
FIG. 6 is a top view of the sleeve of FIG. 5.

The bottle closure 100 includes a decorative sleeve 300. The sleeve 300 is depicted in side view in FIG. 5, and in top view in FIG. 6. The sleeve 300 may be manufactured from aluminium, plastic, or another suitable material which is preferably corrosion resistant. In the embodiment shown in the drawings, the sleeve 300 has dimensions which generally correspond to the outer diameter of the body 202 of the bottle 200. As such, the sleeve 300 provides a continuation of the profile of the bottle 200, when viewed in a direction along the longitudinal axis XX. The sleeve 300 has an inner surface 302 and an outer surface 304.

Figure 7:
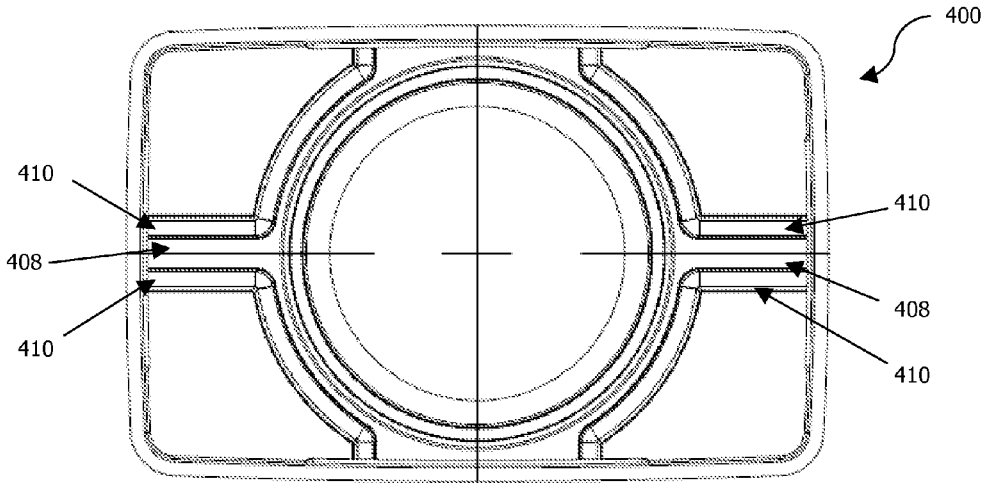
FIG. 7 is a top view of a base plate of the bottle closure.
Figure 8:
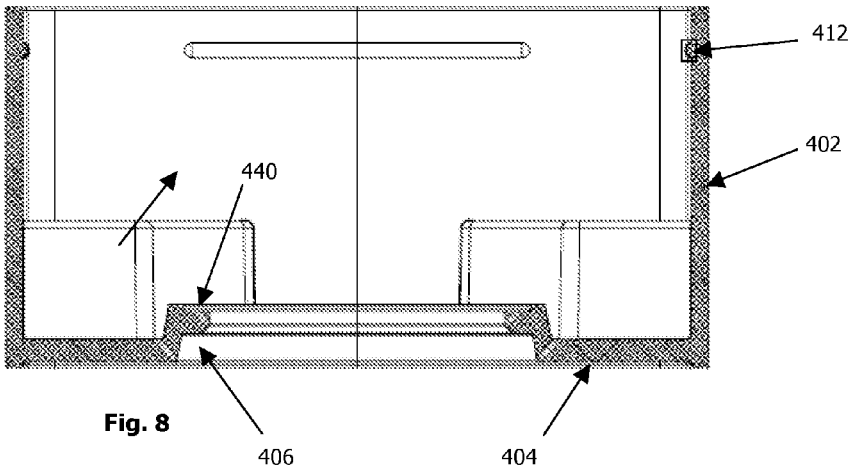
FIG. 8 is a side cross-sectional view of the base plate of FIG. 7.
Figure 9:
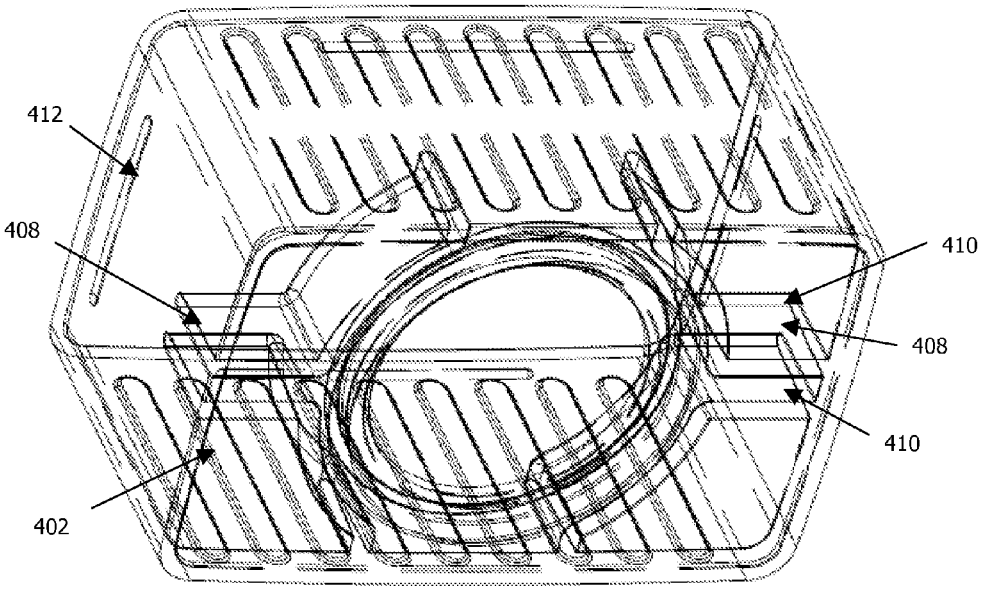
FIG. 9 is a top perspective view of the base plate of FIG. 7.

The bottle closure 100 includes a base plate 400, best seen in FIGS. 7 to 9. The base plate 400 has four outer, longitudinally extending walls 402, generally corresponding in size to the inner surface 302 of the decorative sleeve 300. The decorative sleeve 300 is glued or otherwise attached to the base plate 400, such that the decorative sleeve 300 outwardly masks the base plate 400.

The base plate 400 includes a plurality of longitudinally extending adhesive slots 402 which assist in bonding the base plate 400 to the sleeve 300.

The base plate 400 includes a base portion 404 which is adapted to abut against the upper surface of the bottle 200. A stepped recess 406 is formed in the base portion 404. The stepped recess 406 corresponds generally in size with the radial step 210 formed on the bottle 200. The base plate 200 is able to rotate relative to the bottle 200, and the engagement between the stepped recess 406 and the radial step 210 provides a rotational guide between the base plate 400 and the bottle 200.

The base plate 400 includes two channels 408, which are each defined by two generally parallel ribs 410, extending both radially and longitudinally away from the base portion 404.

The internal surfaces of the walls 402 of the base plate 400 each include one or more ribs or projections 412. The projections 412 extend inwardly. In the embodiment shown in the drawings, there are four projections 412, one provided on each of the four side walls 402 of the base plate 400. The base plate 400 includes an annular surface 440.

Figure 2:
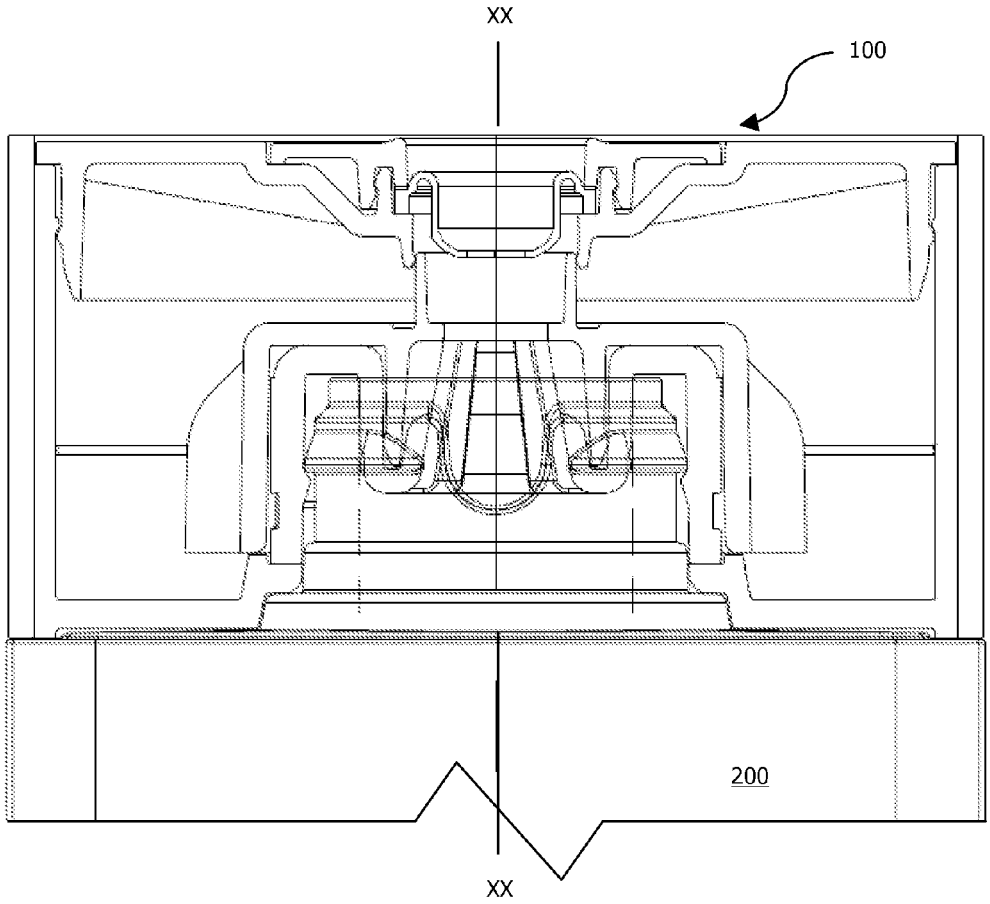
FIG. 2 is a cross-sectional side view of the bottle closure of FIG. 1.
Figure 3:
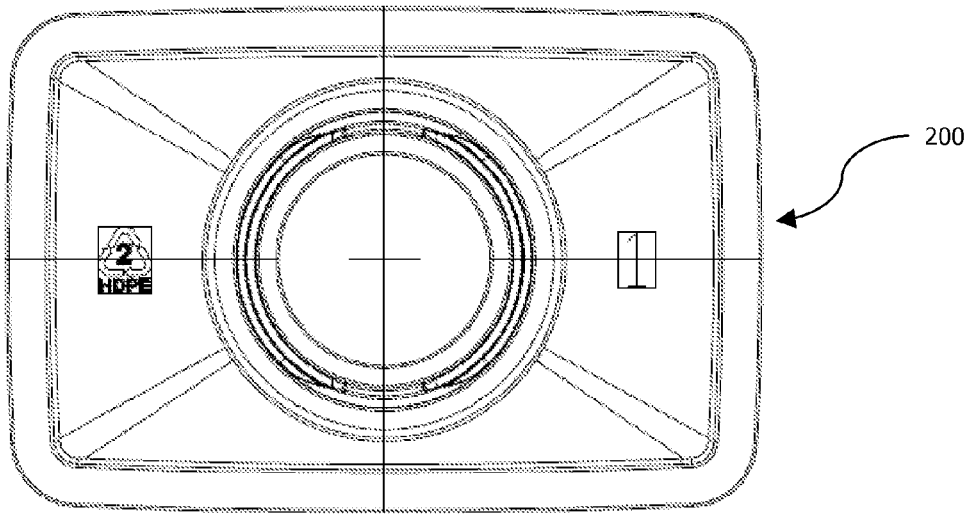
FIG. 3 is a top view of a bottle for use with the bottle closure of FIG. 1.

The bottle closure 100 includes a first, rotating closure 500, best shown in FIGS. 10 to 14. The rotating closure 500 is manufactured from a suitable engineering polymer, metallic or alloy material. A side wall 501 of the rotating closure 500 includes an internal, radially extending rib 502. The rib 502 is adapted to interferingly engage with the barb 206 formed on the bottle 200, as depicted in FIG. 2. This has the effect of semi-permanently securing both the rotating closure 500 and the base plate 400 to the bottle 200. The base plate 400 is secured to the bottle by abutment between the annular surface 440 and a rim 520 of the rotating closure 500.

Figure 10:
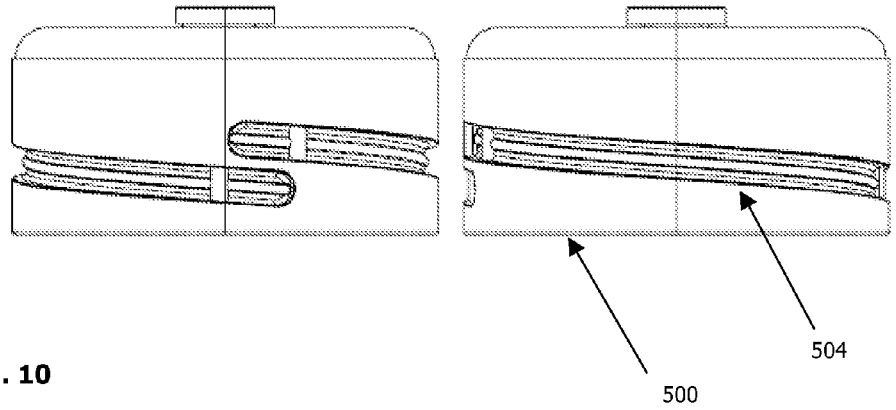
FIG. 10 depicts a front view and a side view of a rotating closure of the bottle closure.
Figure 11:
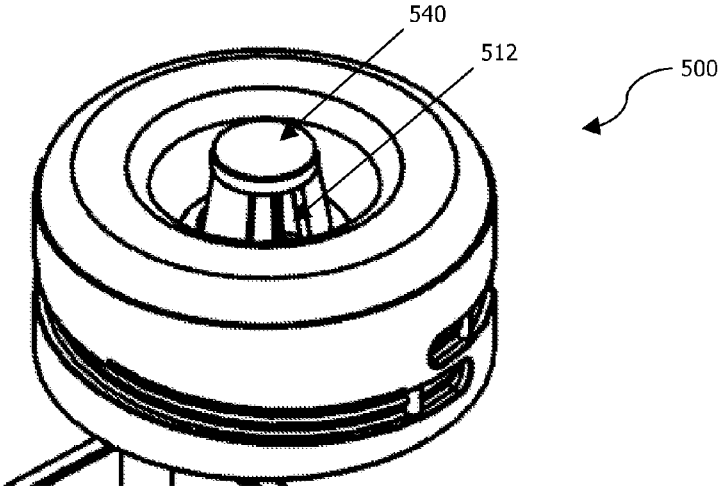
FIG. 11 is a perspective view of the rotating closure of FIG. 10.

The rotating closure 500 includes a pair of helical grooves or channels 504, best seen in FIG. 10, which define a first engagement formation 504. The channels 504 are located on opposing sides of the rotating closure 500, diametrically opposite to each other. The channels 504 each extend around approximately half of the circumference of the rotating closure 500.

A first annular well or depression 560 formed in the underside of the rotating closure 500 is adapted to receive the mouth or opening 204 of the bottle 200.

Figure 12:
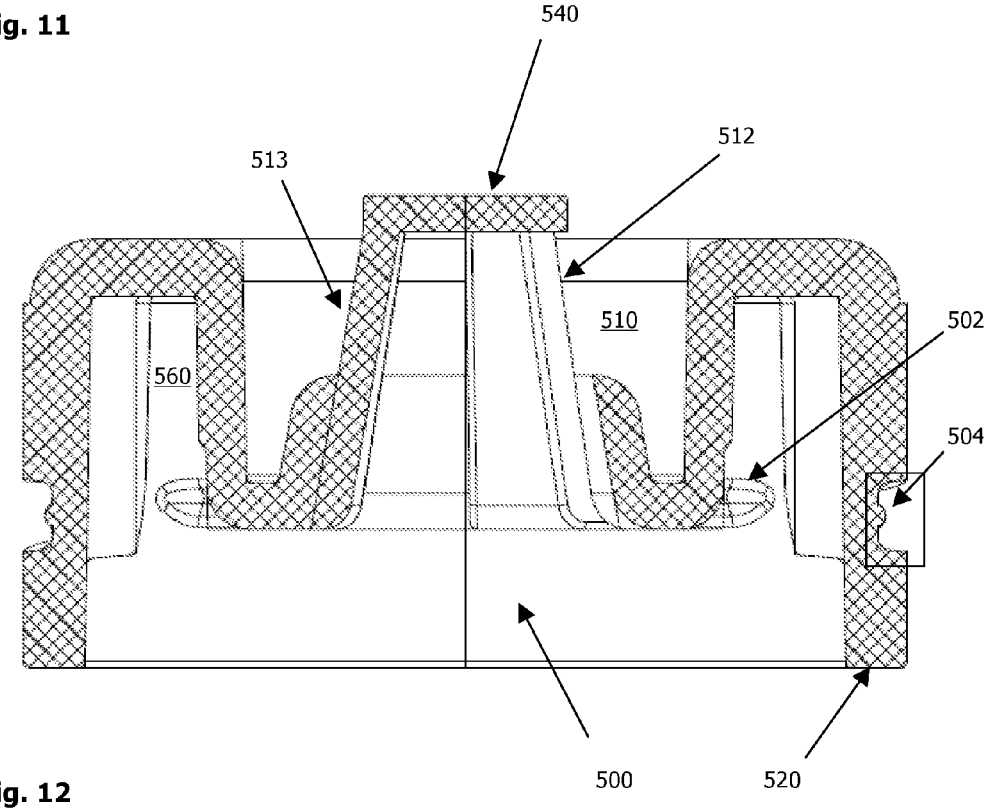
FIG. 12 is a cross-sectional side view of a rotating closure of FIG. 10.
Figure 13:
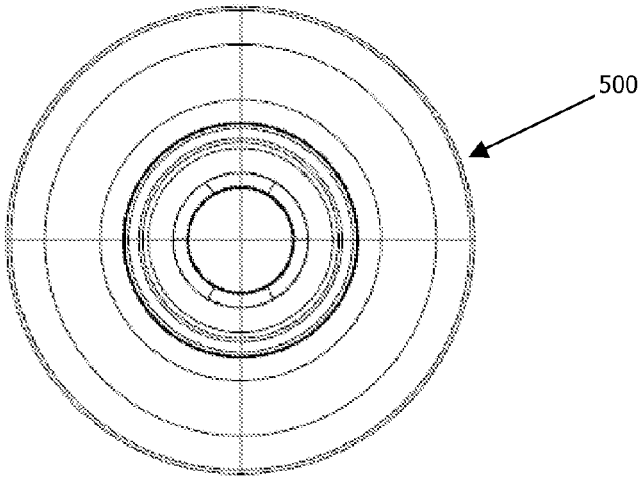
FIG. 13 is a top view of the rotating closure of FIG. 10.
Figure 14:
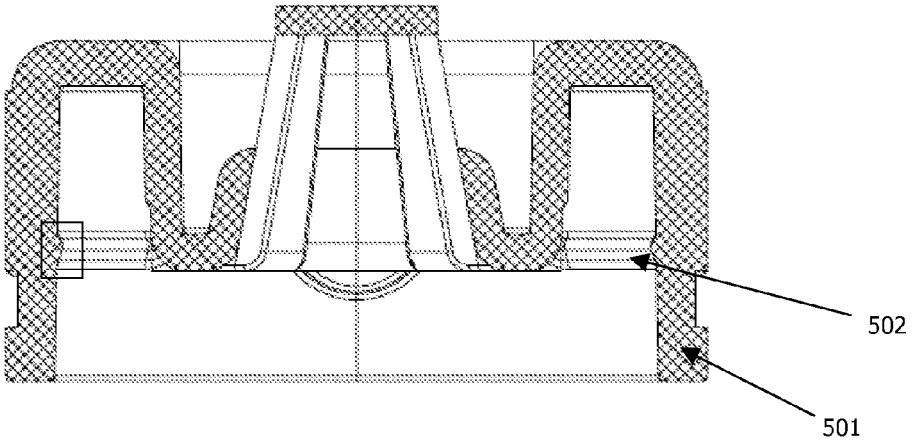
FIG. 14 is a cross-sectional front view of the rotating closure of FIG. 10.

As shown in FIGS. 12 and 14, the rotating closure 500 when viewed from above has a second annular well or depression 510. An aperture 512 is formed in a side wall 513 of the second depression 510, enabling the transmission of liquid through the rotating closure 500.

In an alternative embodiment not depicted in the drawings, there may be two or more liquid flow apertures 512 formed in the rotating closure 500.

An upper portion of the rotating closure 500 defines a central, circular projection 540. The projection 540 is located adjacent to and connected to the side wall 513. The projection 540 forms the highest portion of the rotating closure.

Figure 15:
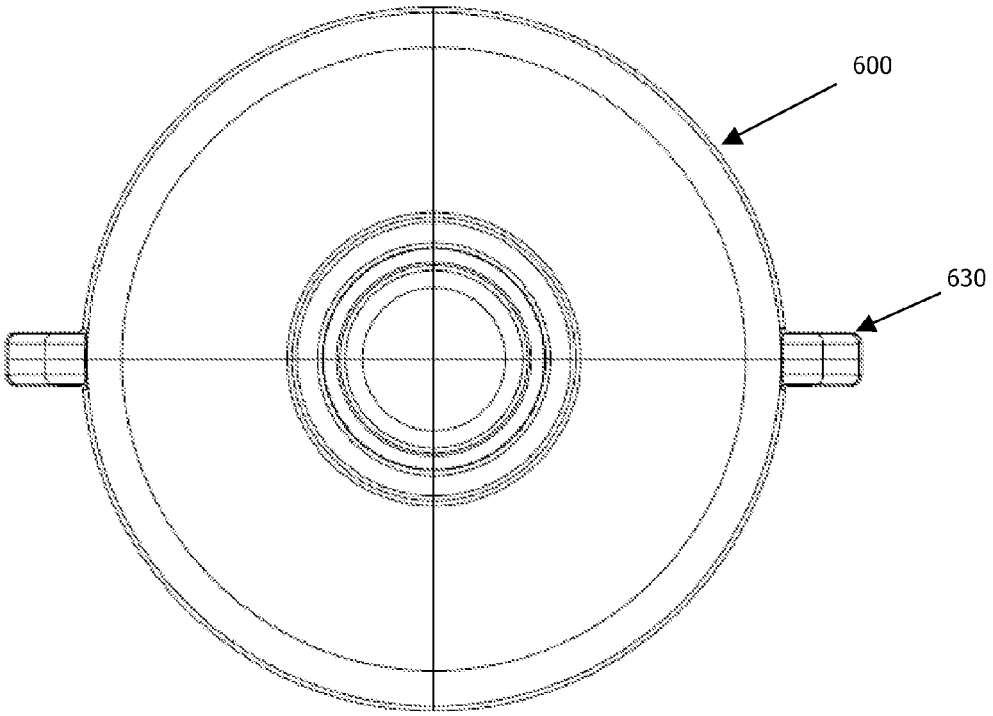
FIG. 15 is a top view of a stationary closure of the bottle closure of FIG. 1.
Figure 16:
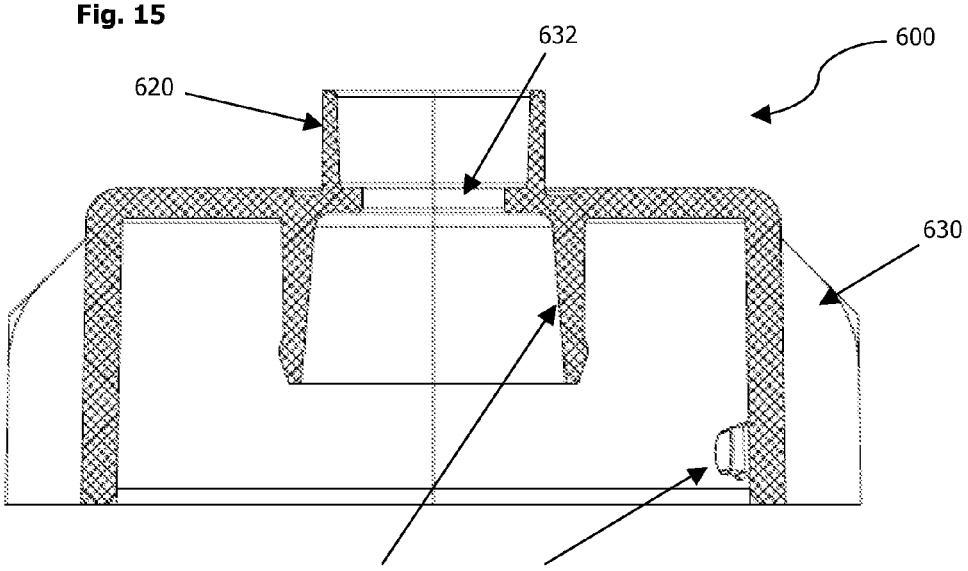
FIG. 16 is a cross-sectional side view of the stationary closure of FIG. 15.
Figure 17:
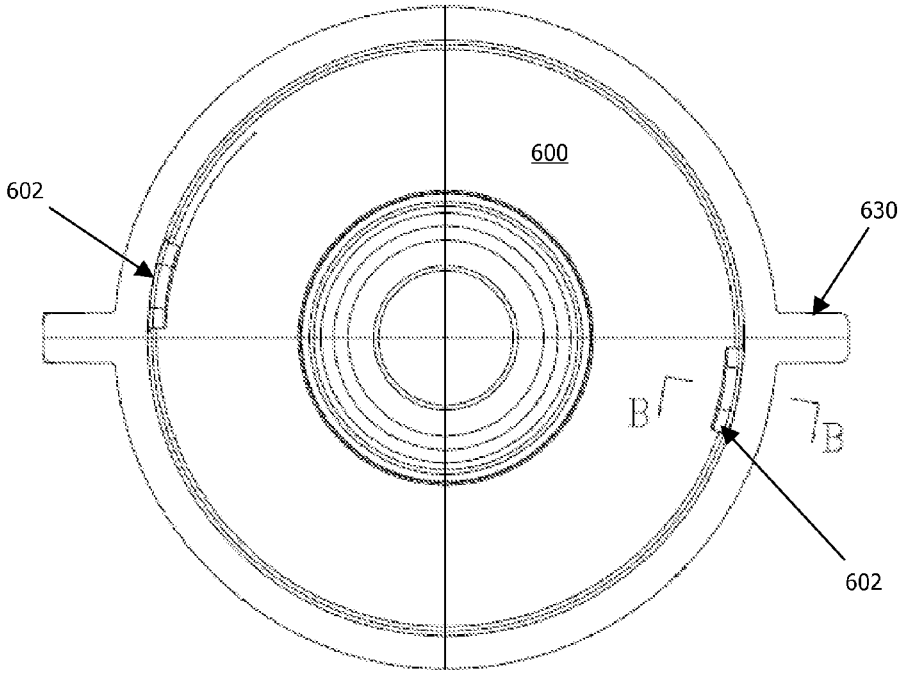
FIG. 17 is a bottom view of the stationary closure of FIG. 15.

The bottle closure 100 also includes a second, stationary closure 600, best seen in FIGS. 15 to 17. The stationary closure 600 includes two diametrically opposing, internally extending projections or lugs 602, which define a second engagement formation 602. The lugs 602 are visible in the bottom view of FIG. 17. The lugs 602 engage with the helical channels 504 of the rotating closure 500.

In an alternative embodiment (not shown), the helical channels may be formed on the stationary closure 600, and the lugs formed on the rotating closure 500.

The stationary closure 600 includes a downwardly depending first skirt 610, which projects into the second annular depression 510 of the rotating closure 500, as best seen in FIG. 2. The stationary closure 600 further includes an upwardly depending second skirt 620, which is smaller in diameter than the first skirt 610. A circular liquid flow aperture 632 extends between the first and second skirts 610, 620.

The circular projection 540 of the rotating closure 500 corresponds in size and is adapted to sit within the circular liquid flow aperture 632, as depicted in the position in FIG. 2. In this configuration, liquid can not readily flow out of the bottle through the aperture 512. This is because the circular projection 540 occludes the circular liquid flow aperture 632. In addition, the first skirt 610 in this position extends into and generally seals the second annular depression 510 of the rotating closure 500.

The stationary closure 600 includes a pair of diametrically opposed wings or tabs 630. The tabs 630 are each adapted to be received by the channels 408 formed in the base plate 400.

The channels 408 engage the tabs 630, such that any rotational movement of the base plate 400 causes the rotation of the stationary closure 600 relative to the bottle 200. However, the channels 408 do not inhibit the movement of the stationary closure in a longitudinal direction, along the longitudinal axis XX. In fact, the interaction of the lugs 602 with the helical channels 504 urges the stationary closure to move axially along the axis XX toward or away from the bottle 100 when the base plate 400 is pivoted about the axis XX.

Figure 18:
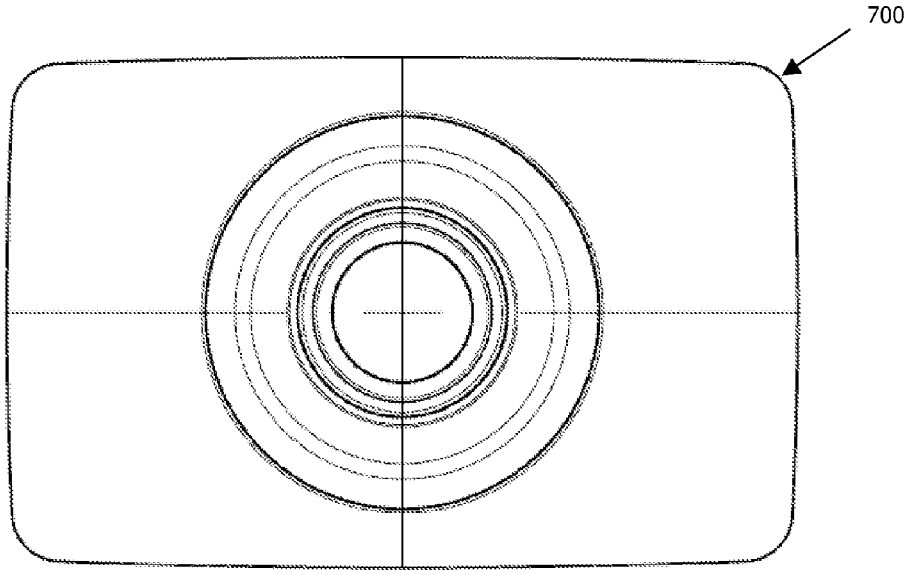
FIG. 18 is a top view of a top plate of the bottle closure of FIG. 1.
Figure 19:
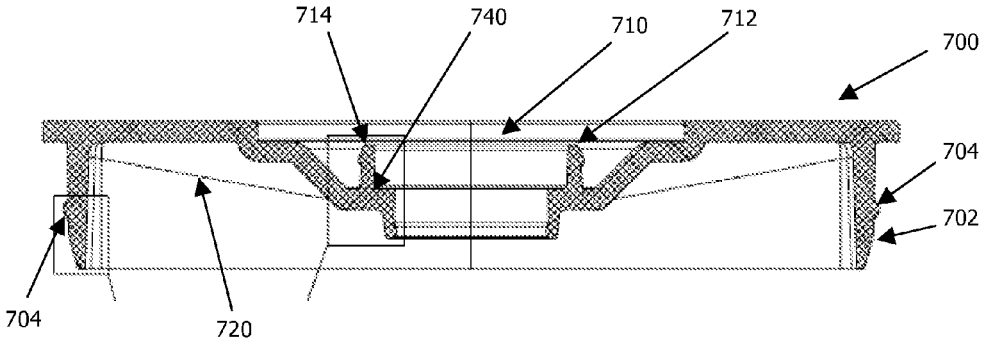
FIG. 19 is a cross-sectional side view of the top plate of FIG. 18.

The bottle closure 100 includes a top plate 700. The top plate 700 is best depicted in FIGS. 18 and 19. The top plate 700 has a downwardly directed flange 702. A plurality of ribs or other such projections 704 are located around an outer wall of the flange 702, and extend generally around the perimeter of the flange 702. As best seen in FIG. 2, the projections 704 interact with the projections 412 of the base plate 400, thereby securing the top plate 700 to the base plate 400.

The top plate 700 also includes a central, generally circular aperture 710. An annular skirt or ring 712 formed on the top plate 700 extends upwardly, away from the top plate, adjacent to the circular aperture 710, as best seen in FIG. 19.

An uppermost portion of the annular ring 712 is flared to provide an engagement formation 714. An underside of the top plate includes a plurality of stiffening ribs 720. The stiffening ribs 720 may be arranged in a radially extending star shaped formation, or any other suitable configuration.

Figure 20:
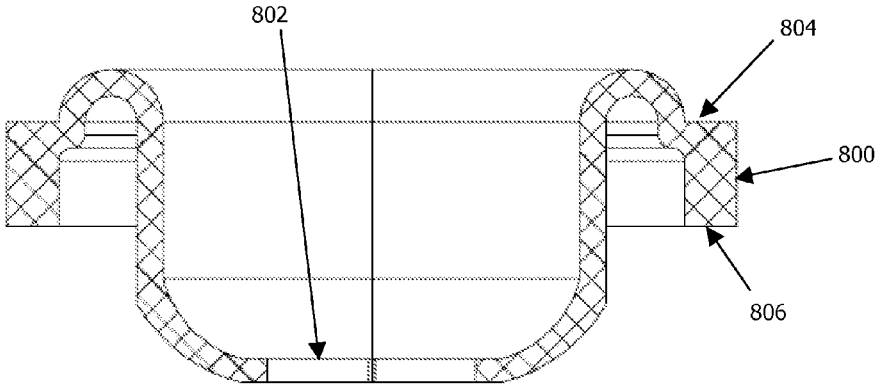
FIG. 20 is a cross-sectional side view of a silicon valve of the bottle closure of FIG. 1.
Figure 21:
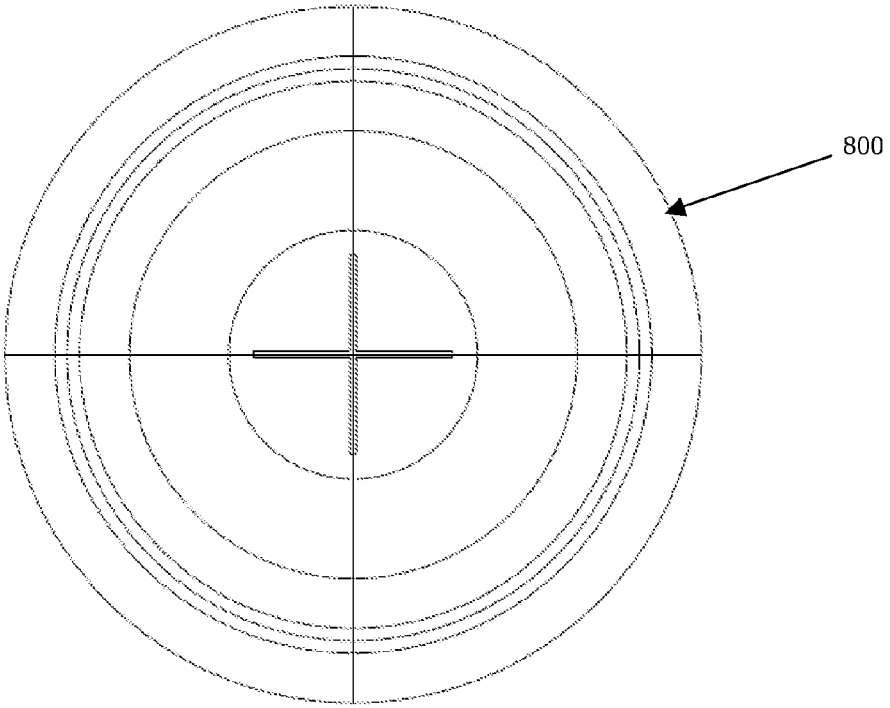
FIG. 21 is a bottom view of the silicon valve of FIG. 20.

The bottle closure 100 includes a flexible valve 800, best shown in FIGS. 20 and 21. The flexible valve 800 is made from silicon and is elastically deformable. An aperture 802 is formed in the flexible or silicon valve 800, in the form of two intersecting slits, defining a cross-shaped aperture 802. A radially outermost portion of the silicon valve defines a shoulder 804. An underside surface 806 of the shoulder 804 is adapted to be seated on an annular seat 740 of the top plate 700.

Figure 22:
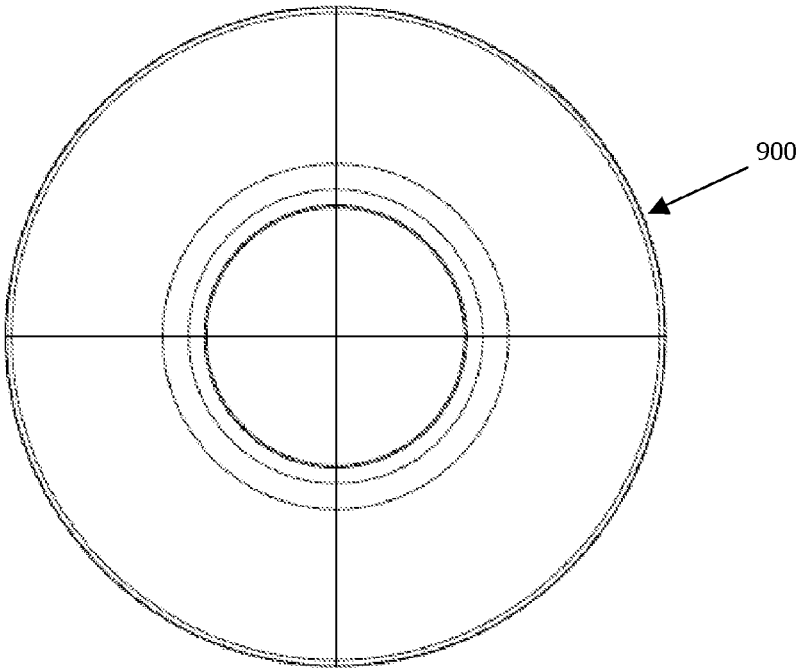
FIG. 22 is a top view of a retainer valve of the bottle closure of FIG. 1.
Figure 23:
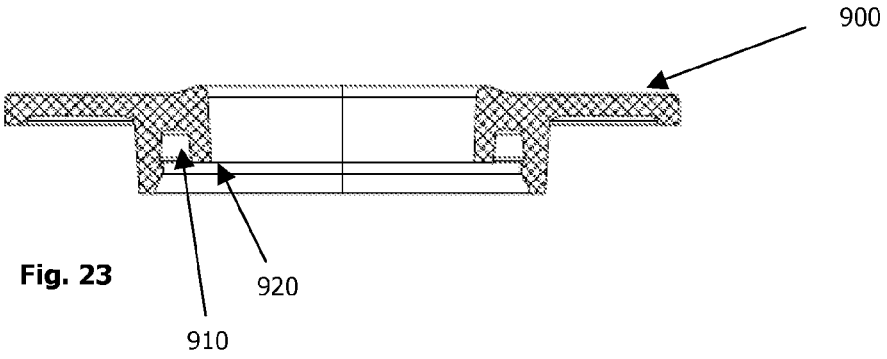
FIG. 23 is a cross-sectional side view of the retainer valve of FIG. 22.

The bottle closure 100 includes a retainer ring or valve 900, shown in FIGS. 22 and 23. Referring to FIG. 23, the retainer valve 900 includes an annular groove which 910 which receives the engagement formation 714 of the top plate 700, to secure the retainer valve 900 to the top plate 700. The retainer valve 900 secures the silicon valve in position. As such, a downwardly extending skirt 920 of the retainer valve 900 clamps the shoulder 804, and in particular the underside surface 806 of the silicon valve against the annular seat 740 of the top plate 700.

Advantageously, the bottle 200 and closure 100 does not require a separate lid or cap to seal the bottle. When the closure 100 is in an open position, ie. when the base plate 400 is pivoted around the axis XX to drive the stationary closure 600 longitudinally away from the rotating closure 500, the liquid flow aperture 632 is open. This is the normal operating condition, in which shampoo or conditioner can be ejected from the bottle 200 by simply squeezing the bottle 200. By doing so, the pressure of air and liquid leaving the bottle 200 forces open the aperture 802 is formed in the silicon valve 800.

The bottle closure 100 is movable between a first position (depicted in FIG. 2) in which the circular projection generally occludes flow through the circular, liquid flow aperture 632 and a second position. In the second position the circular projection 540 is adjacent to the circular liquid flow aperture 632, providing a fluid flow path from the bottle 200, through the liquid flow aperture 632.

Advantageously, the bottle 200 does not require to be 'turned upside down' (i.e. rotated from a position in which the closure 100 is located at the top to a position in which the closure 100 is facing downwardly) to dispense the shampoo. This is because the bottle 200 is designed to sit on the shelf, already in the open (second) position, with the bottle closure 100 located on the underside. This provides a practical advantage, as the shampoo can be ejected very simply and quickly by simply squeezing the bottle. The flexible silicon valve 800 prevents leakage whilst in this second position, even with the closure 100 is facing downwardly.

However, when the shampoo bottle 200 is not in use, for example, when it is on a shelf in the shower, the aperture 802 formed in the silicon valve 800 is closed, and this prevents the ingression of water into the shampoo bottle 200, and unintentional leakage of the contents of the bottle. As such, it is not necessary for the user to return the closure 100 to the closed position after every use.

When a user wishes to seal the closure 100, for example during transportation, the user rotates the sleeve 300 and the base plate 400, which in turn rotates the stationary closure 600 towards the rotating closure 500, until the liquid flow aperture 632 is occluded by the circular projection 540. At this point the closure 100 is sealed.

Advantageously, the range of motion of the closure 100 between fully open and fully closed is represented by approximately 180° of rotation of the sleeve 300 and the base plate 400. As such, the bottle 200 and closure 100 are visually aligned with each other in both the open and closed configurations, which is visually pleasing.

Advantageously, the silicon valve 800 prevents liquid from leaking or dripping out of the bottle 200.

Advantageously, the sleeve 300 visually enhances the appearance of the bottle 200.

Although the invention has been described with reference to specific examples, it will be appreciated by those skilled in the art that the invention may be embodied in many other forms.

The invention claimed is:

1. A bottle closure for a bottle, the bottle closure comprising:

a first closure securable over an opening of the bottle, the first closure having a central generally circular projection, and a liquid flow aperture located adjacent to the projection;

a second closure located over the first closure, the second closure having a generally circular aperture adapted to receive the circular projection, the second closure being movable between a first position and a second position; and a flexible valve, the flexible valve being located adjacent to the circular aperture, wherein in the first position the circular projection generally occludes flow through the circular aperture, and in the second position the circular projection is adjacent to the circular aperture, providing a fluid flow path from the bottle, through the liquid flow aperture and the circular aperture, and further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position, and wherein the first engagement formation includes at least one helical groove, and the second engagement formation includes a corresponding projection.

2. A bottle closure for a bottle, the bottle closure comprising:

a first closure securable over an opening of the bottle, the first closure having a central generally circular projection, and a liquid flow aperture located adjacent to the projection;

a second closure located over the first closure, the second closure having a generally circular aperture adapted to receive the circular projection, the second closure being movable between a first position and a second position;

a flexible valve, the flexible valve being located adjacent to the circular aperture, wherein in the first position the circular projection generally occludes flow through the circular aperture, and in the second position the circular projection is adjacent to the circular aperture, providing a fluid flow path from the bottle, through the liquid flow aperture and the circular aperture, further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position and wherein the first engagement formation includes two diametrically opposing helical grooves.

3. The bottle closure of claim 2, wherein the first closure includes an annular ring adapted to engage with a barb formed on the bottle to secure the first closure to the bottle.

4. A bottle closure for a bottle, the bottle closure comprising:

a first closure securable over an opening of the bottle, the first closure having a central generally circular projection, and a liquid flow aperture located adjacent to the projection;

a second closure located over the first closure, the second closure having a generally circular aperture adapted to receive the circular projection, the second closure being movable between a first position and a second position and wherein the second closure includes two diametrically opposing lugs;

a flexible valve manufactured from an elastically deformable polymer and the flexible valve being located adjacent to the circular aperture;

a base plate, the base plate being securable to the bottle by a rim of the first closure, the base plate having two channels adapted to receive the two diametrically opposing lugs, and wherein the base plate is pivotable about the longitudinal axis relative to the bottle, further wherein pivoting the base plate through about 180° results in the second closure moving between the first position and the second position; and a sleeve located around the base plate, the sleeve having an external cross-section when viewed in a plane extending perpendicular to the longitudinal axis which generally corresponds with an external cross-section of the bottle, and wherein in the first position the circular projection generally occludes flow through the circular aperture, and in the second position the circular projection is adjacent to the circular aperture, providing a fluid flow path from the bottle, through the liquid flow aperture and the circular aperture, further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position.

5. A bottle closure for a bottle, the bottle closure comprising:

a first closure securable over an opening of the bottle, the first closure having a central generally circular projection, and a liquid flow aperture located adjacent to the projection;

a second closure located over the first closure, the second closure having a generally circular aperture adapted to receive the circular projection, the second closure being movable between a first position and a second position and wherein the second closure includes two diametrically opposing lugs;

a flexible valve manufactured from an elastically deformable polymer and the flexible valve being located adjacent to the circular aperture; and a base plate, the base plate being securable to the bottle by a rim of the first closure, the base plate having two channels adapted to receive the two diametrically opposing lugs, and wherein the flexible valve is secured to and adapted to rotate with the base plate, further wherein in the first position the circular projection generally occludes flow through the circular aperture, and in the second position the circular projection is adjacent to the circular aperture, providing a fluid flow path from the bottle, through the liquid flow aperture and the circular aperture, further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position.

6. The bottle closure of claim 5, wherein an annular shoulder of the flexible valve is clamped to a top plate with a retainer ring, the top plate being secured to the base plate.

7. The bottle closure of claim 6, wherein the flexible valve and the second closure are rotationally coupled to pivot the same degree around the longitudinal axis between the first position and the second position.

8. A bottle closure for a bottle, the bottle closure comprising:

a first closure securable over an opening of the bottle, the first closure having a central generally circular projection, and a liquid flow aperture located adjacent to the projection;

a second closure located over the first closure, the second closure having a generally circular aperture adapted to receive the circular projection, the second closure being movable between first position and a second position;

a flexible valve manufactured from an elastically deformable polymer and the flexible valve being located adjacent to the circular aperture, and wherein the flexible valve has a generally cup-shaped body, and the perpendicular slits are located at a low point of the cup-shaped body and wherein the flexible valve include two generally perpendicular slits defining a cross shaped aperture, wherein in the first position the circular projection generally occludes flow through the circular aperture, and in the second position the circular projection is adjacent to the circular aperture, providing a fluid flow path from the bottle, through the liquid flow aperture and the circular aperture, further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position.

9. A bottle closure for a bottle, the bottle closure comprising:

a first closure securable over an opening of the bottle, the first closure having a central generally circular projection, and a liquid flow aperture located adjacent to the projection;

a second closure located over the first closure, the second closure having generally circular aperture adapted to receive the circular projection, the second closure being movable between a first position and a seco position and wherein the second closure includes two diametrically opposing lugs;

a flexible valve manufactured from an elastically deformable polymer and the flexible valve being located adjacent to the circular aperture; and a base plate, the base plate being securable to the bottle by a rim of the first closure, the base plate having two channels adapted to receive the two diametrically opposing lugs, and wherein the base plate is pivotable about the longitudinal axis relative to the bottle, further wherein pivoting the base plate through about 180° results in the second closure moving between the first position and the second position and wherein the flexible valve is secured to and adapted to rotate with the base plate, and wherein in the first position the circular projection generally occludes flow through the circular aperture, and in the second position the circular projection is adjacent to the circular aperture, providing a fluid flow path from the bottle, through the liquid flow aperture and the circular aperture, further wherein the first closure includes a first engagement formation and the second closure includes a corresponding second engagement formation, the first and second engagement formations being adapted to move the second closure both longitudinally and pivotally about a longitudinal axis as the second closure moves between the first position and the second position.

10. The bottle closure of claim 4, wherein the flexible valve is secured to and adapted to rotate with the base plate.

* * * * *